US005443409A

United States Patent [19]

Adamson

[11] Patent Number: 5,443,409

[45] Date of Patent: Aug. 22, 1995

[54] WATER SADDLE

[75] Inventor: Keith Adamson, Mission Viejo, Calif.

[73] Assignee: Orca Industries, Inc., Mission Viego, Calif.

[21] Appl. No.: 212,248

[22] Filed: Mar. 14, 1994

[51] Int. Cl.[6] ..... B63C 9/08

[52] U.S. Cl. ..... 441/130; 441/132

[58] Field of Search ..... 441/129, 130, 131, 132; 472/13, 128, 129

[56] References Cited

U.S. PATENT DOCUMENTS

| | | | |
|---|---|---|---|
| 3,102,280 | 9/1963 | Williams | 441/130 |
| 3,528,116 | 9/1970 | Fenar | 441/130 |
| 4,580,988 | 4/1986 | Correll | 441/130 |
| 4,634,393 | 1/1987 | Wood | 441/129 |
| 4,986,786 | 1/1991 | Helt et al. | 441/129 |
| 5,314,395 | 5/1994 | Ciolino | 441/129 |

*Primary Examiner*—Stephen Avila

*Attorney, Agent, or Firm*—Wagner & Middlebrook

[57] ABSTRACT

A water saddle is formed of a unitary member of expanded plastic such as polystyrene having closed cells on it surface. The saddle includes a center seat located between end sections. The center of the seat portion is narrower than the end sections and includes tapered surfaces to be grasped by a riders legs which extend to a bottom surface which curves downwardly from one end section to a maximum depth below the seat portion and them upwardly to the other end section. The saddle is designed such that the center of buoyancy of the combined saddle and rider is significantly below the surface of the water, leaving the rider's arms, shoulders and head out of the water.

3 Claims, 2 Drawing Sheets

WATER SADDLE

BACKGROUND OF THE INVENTION

This invention relates to flotation devices for augmenting the buoyancy of an individual and more particularly, to a water saddle which a rider can straddle in the water while maintaining a reasonably stable altitude.

There have been flotation devices for individuals to hold to improve their buoyancy in the water going back into pre-history to the use of a log in the water. More recently, there have been innumerable plastic toys which are inflated for children and others to play with in the water and which are deflated for storage. Ring-shaped life preservers which are of cork or plastic have been known for a long time. Many other examples of flotation devices are known.

Plastic flotation toys, either of expanded plastic material or inflatable, have come in many shaped and sizes, but most have been in the form of fanciful animals or other objects and most are not designed to promote any physical orientation or stability for a person in the water. Very small children are often equipped with inflatable rings which can be used to surround their torso or devices which are attached to their upper arms and which are intended to keep a child's head out of the water should he find himself or herself in water which is too deep.

Many kinds of life jackets have been designed which are fastened to the upper body with straps and which afford enough flotation to keep the wearer's head above water. These are, of course, emergency devices and are not designed for recreation or as aquatic exercise devices.

It has been found that there is an desire on the part of many individuals for a flotation device which requires no straps or other attachment means and which provides sufficient buoyancy to permit one to be stable and essentially vertically orientated in the water with at least head, shoulders and arms above the water. This device aids in playing games in the water in performing some aquatic exercises.

BRIEF DESCRIPTION OF THE INVENTION

The invention described herein consists of a water saddle formed of a unitary member of expanded plastic such as polyethylene which is molded with closed cells on its surface and which is in the general shape of a saddle, having a seat, forward and rear raised portions and sufficient depth below the seat for a rider to grasp the saddle between his or her legs and to hold it securely. While the saddle is so held, the rider is maintained essentially upright with arms, shoulders and head out of the water. The seat is somewhat narrower than the forward and rear portions and includes inclined surfaces extending from the top of the seat to the lower surface of the saddle to aid in holding the saddle with the legs. The surface of the saddle is finished with a durable waterproof paint which prevents water from entering the cells of the plastic member.

BRIEF DESCRIPTION OF THE DRAWING

This invention may be more clearly understood with the following detailed description and by reference to the drawings in which.

DETAILED DESCRIPTION OF THE INVENTION

Figure 1:
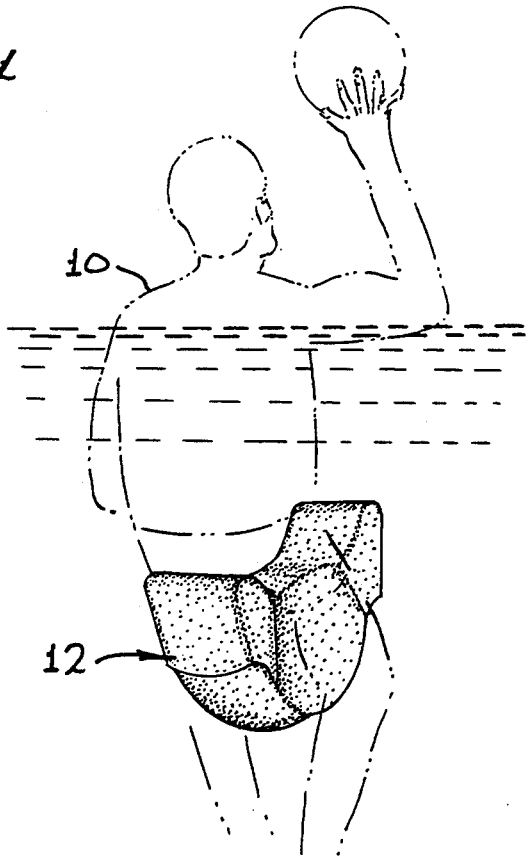
FIG. 1 is a perspective view of a water saddle according to the invention with a rider shown in phantom riding the saddle in the water.

FIG. 1 is a perspective view of the water saddle of the invention shown in the water with a rider. The rider 10 is shown seated on and straddling the water saddle 12. The weight of the rider 10 is such as to keep the water saddle 12 submerged with only the upper part of the rider's body supported out of the water. The center of buoyancy of the combined rider 10 and water saddle 12 is significantly below the surface of the water in which both are placed so that so long as the rider holds the water saddle 12 firmly in position with his legs, there is little tendency for the rider 10 to be tipped or capsized.

Figure 2:
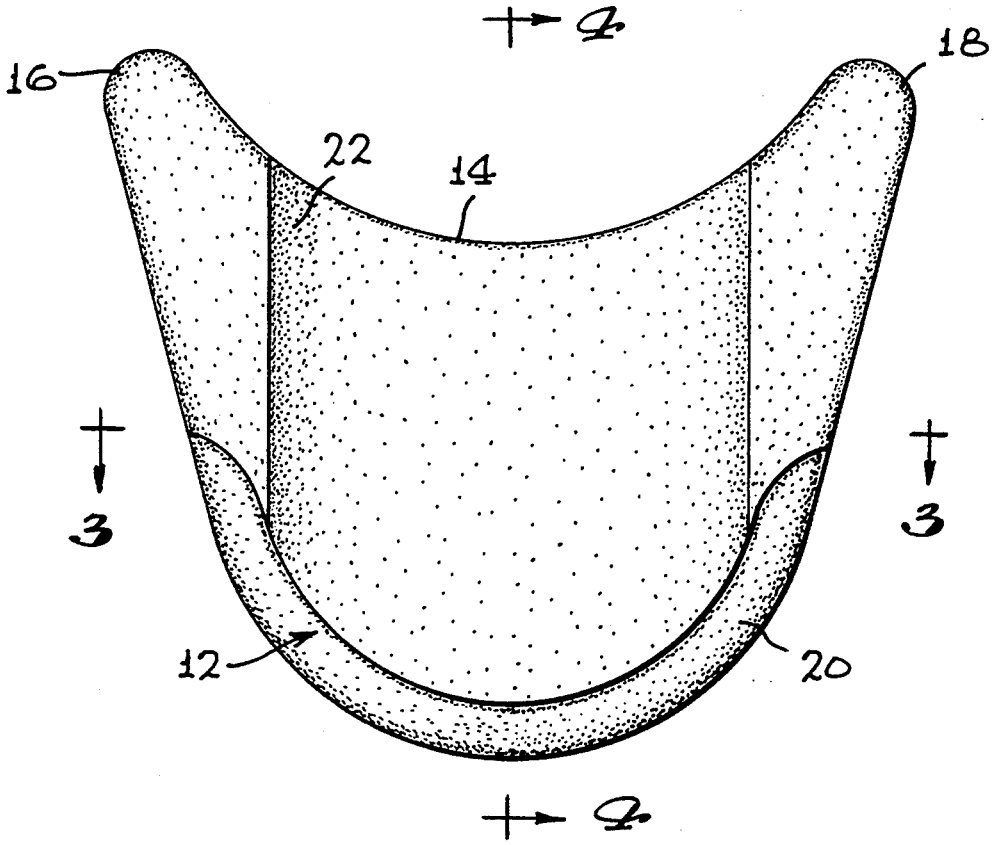
FIG. 2 is a side elevational view of a water saddle of the invention.

FIG. 2 is a side elevational view of the water saddle 12 which includes a centrally located seat portion 14, raised end portions 16 and 18, a lower or bottom surface 20 extending from one end portion to the other below the seat, and indented side grip sections 22 and 24 which extend from the seat portion downwardly to intersect the bottom surface on both sides. Side grip section 24 is not visible in FIG. 2, being on the opposite side.

Figure 3:
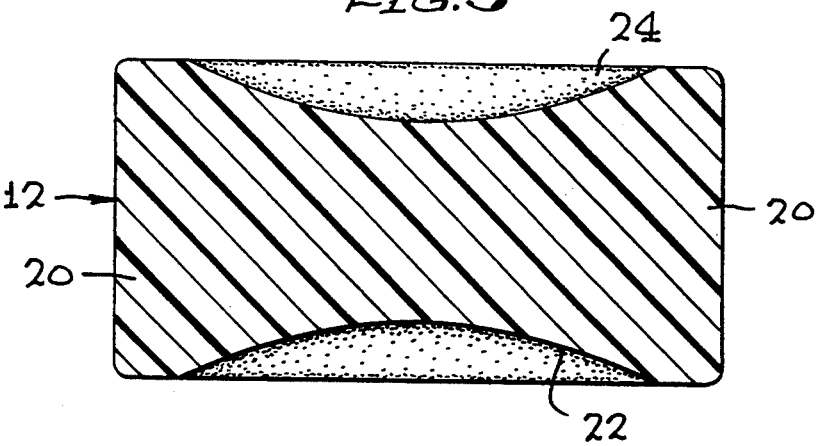
FIG. 3 is a sectional view taken along line 3—3 of FIG. 2.

FIG. 3 is a sectional view taken along line 3—3 of FIG. 2, cutting through two parts of bottom surface 20 where it is uncurved and showing the indented contours of side grip sections 20 and 24.

Figure 5:
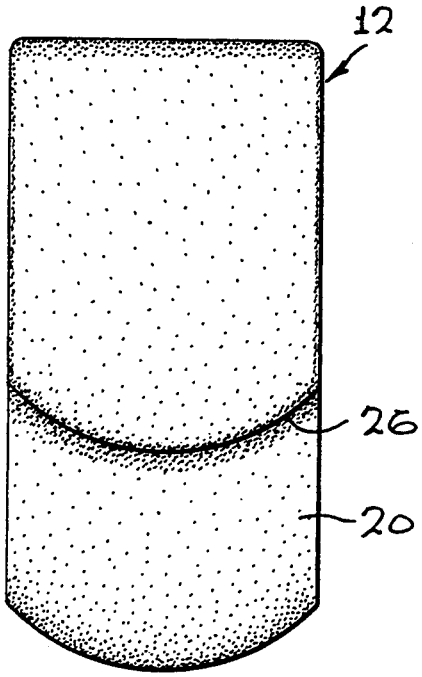
FIG. 5 is an end view of the water saddle of FIG. 2.
Figure 4:
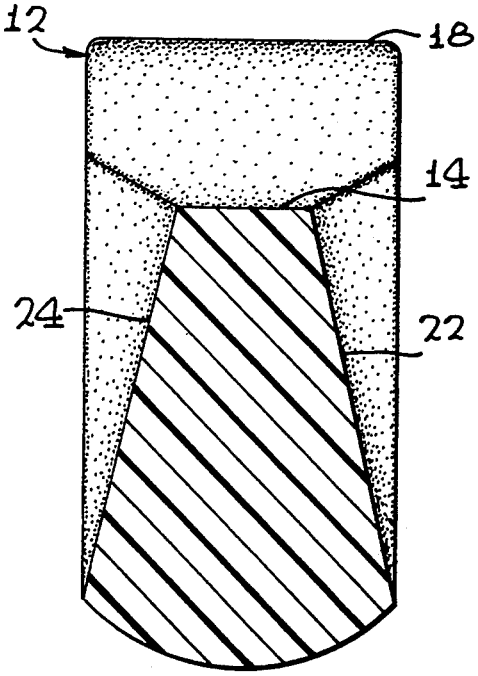
FIG. 4 is a sectional view taken along line 4—4 of FIG. 2.

FIG. 4 is also a sectional view, but taken along line 4—4 of FIG. 2. This view shows that the seat portion 14 reaches a minimum width at its top center with side grip sections 22 and 24 tapering outwardly with the maximum depth of the side grip sections 22 and 24 being directly below the center of seat portion 14. The curved contour at the center of the bottom surface 20 is shown, which curvature extends from just below section line 3—3 on both ends of water saddle 12. This dividing line 26 is shown on FIG. 5 which is an end view of water saddle 12. The end views are the same since water saddle 12 is symmetrical side to side and end to end.

Figure 6:
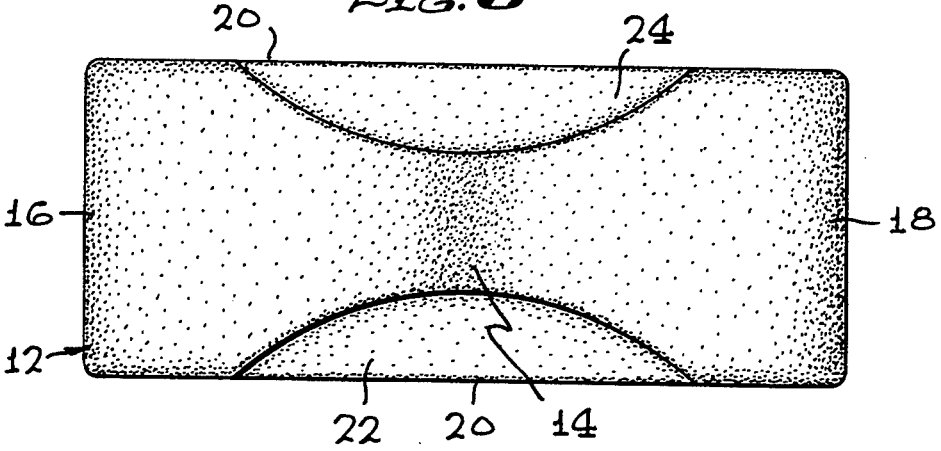
FIG. 6 is a top plan view of the water saddle of FIG. 2.

FIG. 6 is a top plan view of the water saddle 12 and shows seat portion 14 and the raised end portions 16 and 18. From the narrowed seat portion 13, the side grip sections 22 and 24 extend to outside edges of the bottom surface 20.

At stated above, the water saddle 12 is preferably molded of expanded polystyrene with the cells on its surface closed to provide a surface for a coating of waterproof paint. Other expanded plastic materials might be used. It has been determined that one size of saddle is satisfactory for most individuals weighing from approximately 135 lbs to 250 lbs. A smaller saddle is appropriate for individuals from approximately 80 lbs to 135 lbs.

The above described embodiments of the present invention are merely descriptive of its principles and are not to be considered limiting. The scope of the present invention instead shall be determined from the scope of the following claims including their equivalents.

What is claimed is:

1. A saddle for use in the water by a rider, said saddle comprising a unitary member of expanded polystyrene having closed cells on the surface, said member having a raised forward end, a raised rear end, a seat section substantially centered between said forward and rear ends, a bottom surface extending in a continuous smooth curved convex surface from said raised forward end a substantial distance below said seat section to said raised rear end, a top surface extending in a continuous curved surface from the top of said raised forward end across said seat section to said raised rear end, said seat section being centered in said top surface and tapering forwardly and rearwardly from its narrowest width at the center of said top surface toward said ends, said saddle tapering downwardly and outwardly from the center of said top surface to said bottom surface, said saddle being substantially symmetrical forwardly and rearwardly of said seat section.

2. A saddle as claimed in claim 1 wherein said seat section includes tapered surfaces extending at an angle between said top surface and each outside edge of said bottom surface said bottom surface being at the maximum width of said saddle over its entire length.

3. A saddle as claimed in claim 2 wherein the buoyancy of said member is such that said rider when astride said member is supported with at least the rider's arms, shoulders and head above the water.

* * * * *